US005392105A

United States Patent [19]

Moser

[11] Patent Number: 5,392,105

[45] Date of Patent: Feb. 21, 1995

[54] RELEASE AGENT MANAGEMENT SYSTEM FOR APPLYING RELEASE AGENT MATERIAL WHICH IS SOLID AT ROOM TEMPERATURE

[75] Inventor: Rabin Moser, Victor, N.Y.

[73] Assignee: Xerox Corporation, Stamford, Conn.

[21] Appl. No.: 178,157

[22] Filed: Jan. 6, 1994

[51] Int. Cl.[6] ..... G03G 15/20; G03G 21/00

[52] U.S. Cl. ..... 355/284; 118/60; 118/271; 118/DIG. 1; 432/60

[58] Field of Search ..... 355/284, 285; 118/60, 118/70, 76, 101, 104, 200, 271, DIG. 1; 432/60, 75, 228; 219/216, 469, 470; 430/99, 124

[56] References Cited

U.S. PATENT DOCUMENTS

| | | | |
|---|---|---|---|
| 3,716,221 | 2/1973 | Gorka et al. | 118/60 |
| 3,929,094 | 12/1975 | Thettu | 118/60 |
| 3,934,547 | 1/1976 | Jeffo et al. | 118/60 |
| 3,941,085 | 3/1976 | Hattler et al. | 118/60 |
| 4,214,549 | 7/1980 | Moser | 118/60 |
| 4,272,179 | 6/1981 | Seanor | 219/216 X |
| 4,287,280 | 9/1981 | Swift | 430/99 |
| 4,515,884 | 5/1985 | Field et al. | 430/99 |
| 4,770,116 | 9/1988 | Moser | 118/60 |
| 4,949,667 | 8/1990 | Yoshida et al. | 118/60 |

FOREIGN PATENT DOCUMENTS

| | | | |
|---|---|---|---|
| 56-6280 | 1/1981 | Japan | 355/284 |
| 61-170771 | 8/1986 | Japan | 355/284 |

*Primary Examiner*—William J. Royer

[57] ABSTRACT

Release agent material which is solid at room temperature is provided in a sump for application to a heated fuser roll structure. A pressure roll structure contacts the solid release agent material and a source of heat energy serves to elevate the solid release agent material to its operating temperature which is well below the operating temperature of the heated fuser roll.

A metering blade contacting the pressure roll structure causes the liquefied release agent material to be metered to the desired thickness.

9 Claims, 1 Drawing Sheet

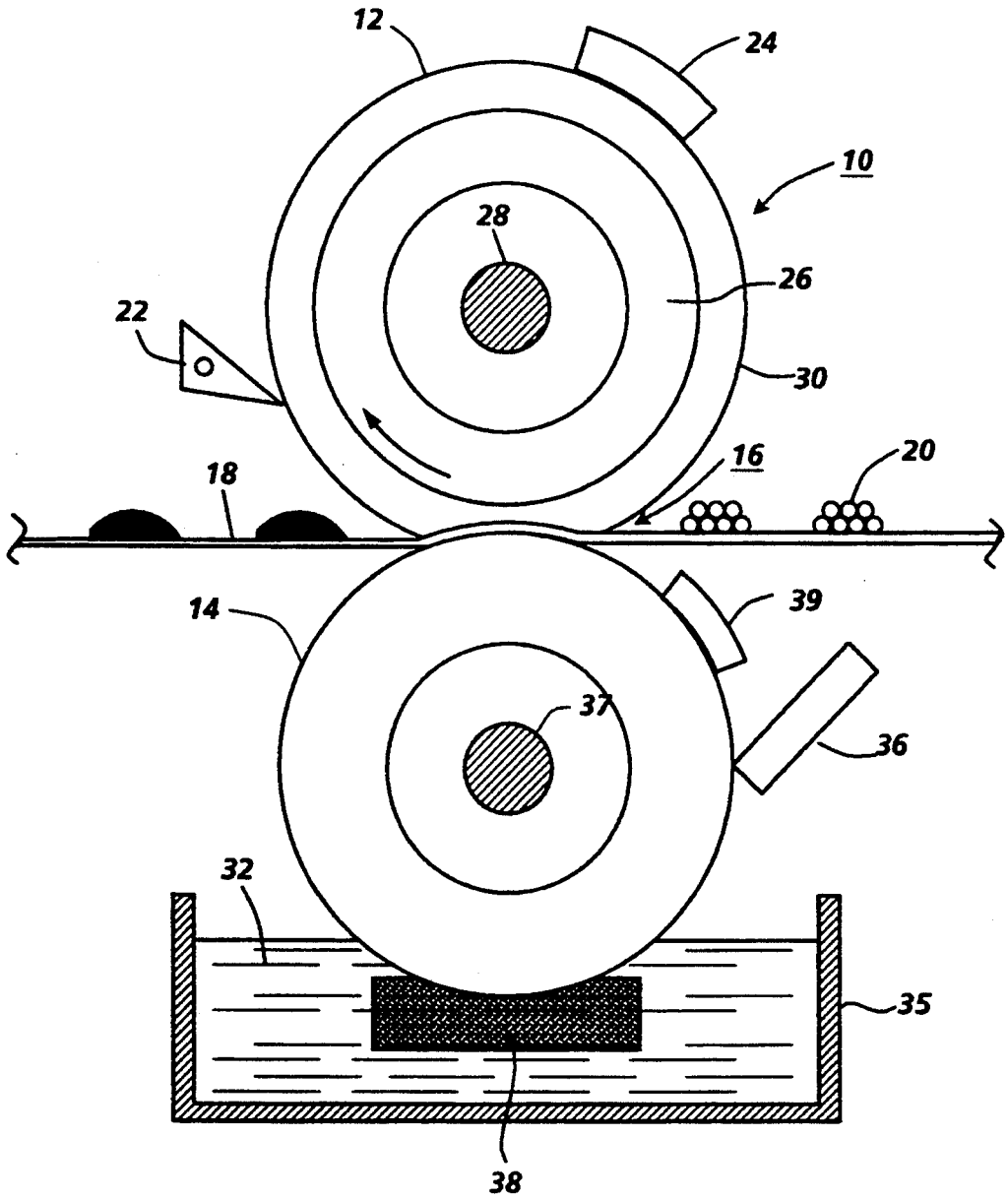
12
24
10
28
26
22
30
16
20
18
14
39
37
36
32
35
38

RELEASE AGENT MANAGEMENT SYSTEM FOR APPLYING RELEASE AGENT MATERIAL WHICH IS SOLID AT ROOM TEMPERATURE

BACKGROUND OF THE INVENTION

This invention relates generally to xerographic copying apparatus and, more particularly, to a contact fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from tile member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll to thereby effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquefy and cause a splitting action in the molten toner to thereby result in hot offset. Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, commonly known as Teflon, to which a release agent such as silicone oil is applied, the thickness of the Teflon being on the order of several mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus a low surface energy layer is presented to the toner as it passes through the fuser nip and thereby prevents toner from offsetting to the fuser roll surface.

The release agent material can be applied directly to the heated fuser roll or it can be applied indirectly via the pressure roll. Use of a donor roll RAM (Release Agent Management) system is one way of applying the release agent to the fuser roll. Donor roll RAM systems have been used as part of roll fuser apparatus for some time. Such a RAM system is disclosed in U.S. Pat. No. 4,214,549 issued on Jul. 29, 1980 to Moser This patent illustrates a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The pressure roll is the softer of the two rolls, therefore, the nip is formed by the harder fuser roll indenting the softer pressure roll. The heated fuser roll is characterized by an outer layer or surface which by way of example is fabricated from a silicon rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll.

U.S. Pat. No. 3,716,221 issued on Feb. 13, 1973 to Gorka et al discloses a heat and pressure fuser roll wherein the heated fuser roller includes a fusing roller having a resilient fusing blanket supported on the periphery thereof and heating means to heat the fusing blanket to a temperature sufficient to fuse the particulate material on a copy sheet. A backup roller is urged toward engagement with the deformable fusing blanket to press the receptor sheet carrying the particulate material into contact with the fusing roller. The fuser roller is coated with an offset preventing liquid which is applied thereto from the backup roller at predetermined intervals during operation of the device. The offset preventing liquid is applied to the backup roller via a wick, one end of which is immersed in a quantity of the liquid which is contained in a receptacle. The application of the liquid to the backup roller is controlled such that it is applied once every eleventh revolution of the fuser roller. In other words ten copy sheets are passed through the fuser and then the fuser and backup rollers are rotated an eleventh time without a copy sheet passing therebetween at which time the liquid is applied to the fuser roller via the wick and backup roller.

U.S. Pat. No. 3,929,094 granted to Raghulinga R. Thettu on Dec. 30, 1975 discloses a contact fuser assembly wherein a heater is provided in a sump of a RAM system for melting a release agent material which is solid at room temperature. The melted release agent is applied to a heated fuser roll supported for pressure contact with a Viton (Trademark of E. I. dupont de Nemours and Company) coated pressure roll.

U.S. Pat. No. 3,934,547 granted to Jelfo, et al. on Jan. 27, 1976 discloses a contact fuser assembly for use in an electrostatic reproducing apparatus including an internally heated fuser roll structure comprising a rigid, thermally conductive core which is coated during operation of the assembly with a thin layer of a normally solid thermally stable material with subsequent application of a liquid release agent to the coated core. In the preferred embodiment of the invention the coating material comprises a fluorocarbon telomer such as Vydax 1000 and the liquid release agent comprises a liquid silicone oil.

U.S. Pat. No. 3,941,085 granted to Hattier, et al on Mar. 2, 1976 discloses an apparatus in which release material is applied to a heated fuser member. A backup member is in communication with the fuser member and a sheet of support material having particles thereon passes therebetween. The particles on the sheet of support material contact the fuser member. The apparatus reciprocates a bar of release material into and out of contact with the fuser member.

U.S. Pat. No. 4,770,116 granted to Rabin Moser on Sept. 13, 1988 discloses a heat and pressure roll fusing apparatus for fixing toner images to copy substrates, the toner comprising a thermoplastic resin. The apparatus includes an internally heated fuser roll cooperating with a bare metal backup or pressure roll to form a nip through which the copy substrates pass with the images contacting the heated roll. The heated fuser roll is characterized by an outer layer or surface which by way of example is fabricated from a silicon rubber or Viton material to which a low viscosity polymeric release fluid is applied. Release fluid is contained in a sump and the pressure roll is partially immersed in the fluid. Thus, the release fluid is applied to the surface of the internally heated fuser roll via the bare metal pressure.

RAM systems such as the ones discussed above are either spill proof and expensive or vice versa. Moreover, the use of liquid release agents such as silicone oil with silicone rubber coated fuser or pressure rolls results in roll swell. As will be appreciated, it is highly desirable that a RAM system be spill proof, highly reliable and be capable of dispensing a low rate of oil. Also, is desirable that the release agent not cause either the pressure or fuser roll to swell.

BRIEF SUMMARY OF THE INVENTION

In accordance with the present invention as will be described hereinafter in greater detail, a release agent material which is solid at room temperature is applied to the pressure roll of a heat and pressure roll fuser apparatus. The pressure roll comprises a hard bare metal roll similar to the metering roll in the aforementioned Moser patent. The pressure roll contacts a quantity of release agent contained in a sump and a metering blade is provided for effecting the application of a thin layer of oil of a predetermined thickness onto the pressure roll. The fuser roll has a relatively thick outer layer of silicone rubber thereby providing a conformable roll which cooperates with the hard pressure roll to form a nip forming heat and pressure fuser.

Application of release agent material to a fuser roll via the pressure roll enables high reliability and a low oil rate Release Agent Management (RAM) system.

A heater structure disposed internally of the pressure roll serves to liquefy the solid release agent for application to the pressure roll and to the fuser roll via the pressure roll. The power supplied to the pressure roll is substantially less than that applied to the fuser roll.

Because the release agent material is solid at room temperature, it does not spill when the fuser is being transported, either with the machine in which it is used or by itself. The use of a solid release agent as described facilitates the use of such fusers as an integral part of a Customer Replaceable Unit (CRU). Recycling of the fuser unit or CRU is also facilitated by the use of a release agent that is solid at room temperature.

DESCRIPTION OF THE DRAWING

The single FIGURE is a side elevational schematic view of a heat and pressure fuser incorporating the present invention.

DETAILED DESCRIPTION OF THE PREFERRED EMBODIMENT OF THE INVENTION

Referring now to the FIGURE, it can be seen that the invention is directed to a roll fuser apparatus generally indicated 10. The fuser apparatus comprises a heated roll structure 12 cooperating with a heated backup or pressure roll structure 14 to form a nip 16 through which a copy substrate 18 passes with toner images 20 formed thereon in a well known manner. The toner images 20 contact the heated roll structure while a force is applied between the roll structure in a well known manner to create pressure therebetween resulting in the deformation of the fuser roll structure by the pressure roll structure to thereby form the nip 16.

As the substrate passes out of the nip, it is stripped from the heated roll structure by a plurality (only one shown) of stripping devices 22 after which it is free to move along a predetermined path toward the exit of the machine(not shown) in which the fuser apparatus 10 is to be utilized.

A contact temperature sensor 24 is provided for sensing the surface temperature of the roll structure 12 and in conjunction with conventional circuitry (not shown) maintains the surface temperature to a predetermined value, for example, in the order of 300°–400° F. The heated roll structure 12 comprises a hollow cylinder 26 having a radiant quartz heater 28 disposed in the hollow thereof. When suitably energized via the aforementioned circuitry, the heating element 28 radiates heat to the cylinder which is then conducted to the outer surface of an outer layer 30 of the structure 12 which layer is preferably fabricated from silicone rubber or "Viton" and is conformable.

The backup or pressure roll structure 14 which comprises a bare metal roll, contacts a release agent material 32 contained in a sump 35. The release agent material 32 comprises a low molecular weight material which is solid at room temperature and has a relatively low viscosity at its operating temperature. An example of such a material is a polyethylene homopolymer manufactured by Allied Chemical Co. and which is designated AC-8 homopolymer. A heating element 37 is supported internally of the pressure roll 14 and serves; to elevate the temperature of the release agent material to an operating temperature approximately in the range of 200° to 300° F. A contact temperature sensor 39 is used to monitor the surface temperature of the pressure roll for maintaining it at a suitable temperature for raising the temperature of the release agent material to its operating temperature. Other solid release agents are contemplated such as silicone greases that are solid at room temperature. As will be appreciated,toners having different fusing temperatures may be utilized in the practice of the invention. In practice, when toners requiring an operating temperature of around 300° F. are used a release agent that has an operating temperature near the lower temperature in the aforementioned range is used. When using toners that require a higher operating temperature, for example 400° F., the operating temperature of the release agent material is at or near the top of the aforementioned temperature range, for example, around 300° F.

A metering blade 36 which may be mounted in a conventional manner adjacent to and in contact with the pressure roll serves to meter the release agent material on the surface of the pressure roll to a desired thickness. A wick 38 supported by the sump 35 contacts the surface of the pressure roll 14 and is immersed in the release agent 32 when it is in its liquid state. The purpose of the wick is to provide an air seal which disturbs the air layer formed at the surface of the roll 14 during rotation thereof. If it were not for the function of the wick, the air layer would be coextensive with the surface of the roll immersed in the release agent thereby precluding contact between the pressure roll and the release agent.

The blade 36 is preferably fabricated from "Viton" is $\frac{3}{4}\times\frac{1}{8}$ in cross section and has a length coextensive with the pressure roll. The edge of the blade contacting the metering roll has a radius of 0.001–0.010 inch. The blade functions to meter the release agent picked up by the roll 14 to a predetermined thickness, such thickness being of such a magnitude as to resulting a fraction of a microliter to several microliters of release agent consumption per copy.

While the pressure roll has been disclosed as a rigid bare metal roll and the heated fuser roll structure as being conformable, it will be appreciated that any construction that yields the desired results is within the spirit and scope of this invention. In other words, any combination of roll structures that provides minimum contact between the pressure roll and the backside of the copy substrate and a maximum of contact between it and the heated roll structure. An important aspect of the invention resides in the application of the release agent material as a thin layer on the pressure roll. The thickness of the release agent on the pressure roll is such that the release agent is transferred only to the areas of contact between the pressure roll and the copy substrate or the heated roll structure. Thus, where the area of contact is small, as in the case of the pressure roll and the copy substrate due to the surface structure of paper, only very little release agent is transferred. In the case of the heated roll structure where the area of contact is great due to conformability of the fuser roll surface, the transfer of release agent is maximized.

If the release agent were applied as a relatively thick layer or as drops or droplets, a greater transfer of release agent would occur between the pressure roll and the copy substrate even though the area is not large. This is because the transfer is not solely a function of contact area but also release agent thickness.

What is claimed is:

1. Contact fuser apparatus for fixing toner images to copy substrates, said apparatus comprising:

a fuser roll structure;

means for internally heating said fuser roll structure for elevating the surface temperature thereof to a first predetermined temperature;

a sump;

a quantity of solid release agent material in said sump;

a pressure roll structure supported for pressure contact with said fuser roll structure to form a nip through which copy substrates pass with toner images carried by said substrates contacting the fuser roll structure, said sump being disposed relative to said pressure roll structure whereby contact of said pressure roll structure with said solid release agent material is effected; and means for elevating said solid release agent material to a second predetermined temperature substantially lower than said first predetermined temperature for causing said solid release agent material to liquefy whereby liquid release agent material can be picked up by said pressure roll structure for conveyance onto said fuser roll structure.

2. Apparatus according to claim 1 wherein said second predetermined temperature is sufficient to raise said solid release agent material to its operating temperature during fusing.

3. Apparatus according to claim 2 including means for metering said liquid release agent material to a predetermined thickness on said pressure roll structure.

4. Apparatus according to claim 3 wherein said means for metering comprises a blade contacting said pressure roll structure.

5. Apparatus according to claim 4 including a wick in said sump for contacting said pressure roll structure.

6. Apparatus according to claim 5 wherein said fuser roll structure comprises a conformable fuser roll structure and said pressure roll structure comprises a hard roll structure.

7. Apparatus according to claim 5 wherein said first predetermined temperature is in the range of 300°–400° F. and the operating temperature of the liquid release agent material is in the order of 200°–300° F.

8. Apparatus according to claim 2 wherein said solid release agent material comprises a polyethylene wax or other release material of similar melt characteristics.

9. Apparatus according to claim 1 wherein said first predetermined temperature is in the range of 300°–400° F. and the operating temperature of the liquid release agent material is in the order of 200°–300° F.

* * * * *